US005297699A

United States Patent [19]

Barchus

[11] Patent Number: 5,297,699

[45] Date of Patent: Mar. 29, 1994

[54] INTERNALLY-COUPLED DUAL ROLLER TUBE SQUEEZING DEVICE

[76] Inventor: David D. Barchus, 3673 Taft Ct., Wheat Ridge, Colo. 80033

[21] Appl. No.: 42,613

[22] Filed: Apr. 2, 1993

[51] Int. Cl.[5] ..... B65D 35/28

[52] U.S. Cl. ..... 222/102

[58] Field of Search ..... 272/92, 95, 102; 24/16 R, 543, 563; 251/6

[56] References Cited

U.S. PATENT DOCUMENTS

| | | | |
|---|---|---|---|
| 1,773,104 | 8/1930 | Johnson | 222/102 |
| 1,983,462 | 12/1934 | Johnson | 222/102 |
| 2,358,989 | 9/1944 | Marcy | 222/102 |
| 3,999,688 | 12/1976 | Hicks | 222/102 |
| 4,405,062 | 9/1983 | Tschida, Sr. | 222/102 |
| 4,639,251 | 1/1987 | Kirkland | 222/102 |
| 5,167,348 | 12/1992 | Okami et al. | 222/102 |

FOREIGN PATENT DOCUMENTS

| | | | |
|---|---|---|---|
| 444344 | 1/1949 | Italy | 222/102 |
| 446267 | 3/1949 | Italy | 222/102 |
| 452153 | 10/1949 | Italy | 222/102 |
| 464081 | 6/1951 | Italy | 222/102 |
| 91/09783 | 7/1991 | World Int. Prop. O. | 222/102 |

*Primary Examiner*—Andres Kashnikow

*Assistant Examiner*—Philippe Dergkshani

*Attorney, Agent, or Firm*—John R. Flanagan

[57] ABSTRACT

A tube squeezing device includes a pair of hollow rollers, a coupling strap in a looped configuration inserted through the rollers, and a connection securing opposite ends of the strap together in offset relation to the remainder of the looped strap. Each elongated hollow roller is made of rigid material and has an interior bore extending between and open at a pair of opposite ends. The coupling strap is made of a substantially resilient flexible inelastic material. The strap has a pair of opposite ends and is of a length sufficient to permit the opposite ends of the strap to extend beyond an adjacent one pair of the pairs of opposite ends of the rollers. The connection secures the opposite ends of the coupling strap together to close the looped strap about adjacent longitudinal portions of the rollers. The connection is disposed in the bore of one of the rollers and to one side of an endless path defined by the looped strap. The closed strap retains the rollers in a spaced apart relationship in which a slot is defined therebetween adapted to receive therethrough a closed end of a flexible fluiddispensing tube. The material of the coupling strap is sufficiently resilient to urge the rollers toward one another to apply squeezing forces to opposite sides of the tube.

20 Claims, 1 Drawing Sheet

INTERNALLY-COUPLED DUAL ROLLER TUBE SQUEEZING DEVICE

BACKGROUND OF THE INVENTION

1. Field of the Invention

The present invention generally relates to a flexible tube squeezing device and, more particularly, is concerned with an internally coupled dual roller flexible tube squeezing device.

2. Description of the Prior Art

It is a common problem for a user dispensing a fluid material, such as toothpaste, shampoo, adhesive, caulking, paints, etc., by manually squeezing a flexible tube, to have the contents of the tube spread throughout the tube. In particular, the contents spreads to the closed end of the tube as the user is attempting to dispense the contents from the open end.

The problem becomes greater as the tube becomes less full. Each time it is desired to dispense more of the fluid material, the user must first squeeze the tube starting at its closed end and working toward the open end in order to gather the contents at the open end.

It has been found desirable to provide assistance to the manual dispensing of the fluid material contained within the flexible tube in such a manner that precludes the contents from spreading to the closed end of the tube. The desired objective is to gather the contents towards the open end of the flexible tube, close off the emptied portion of the flexible tube, and thereby make each successive dispensing of a portion of the tube's contents as easy as the first.

A number of dual roller tube squeezing devices have been proposed in the prior patent art that attempt to provide this assistance to manual dispensing. Some representative examples of such tube squeezing devices are the ones disclosed in U.S. Pat. Nos. to Johnson (1,773,104 and 1,983,462), Hicks (3,999,688), and Kirkland (4,639,251), Italian patents to Bossi (444,344), Rubin (446,267 and 452,153) and Massai (464,081), and WIPO Intl. Publ. No. WO 91/09783. Many of these dual roller tube squeezing devices utilize pairs of cylindrical rollers which provide a slot between them into which the closed end of the flexible tube can be inserted. However, a practical and effective technique to couple the rollers together has yet to be found. Several of the dual roller tube squeezing devices disclosed in Italian Pat. No. 452,153 to Rubin utilize continuous loops in the form of either coil springs or elastic bands which extend through the central passages of the rollers and between the opposite ends thereof for internally coupling the rollers together. The rollers can be made of either nonelastic or elastic material.

However, the Rubin patent fails to disclose a practical technique for assembling these internally coupled dual roller tube squeezing devices. As a result, a need still exists for improvement in the design and construction of an internally coupled dual roller flexible tube squeezing device.

SUMMARY OF THE INVENTION

The present invention provides a flexible tube squeezing device designed to satisfy the aforementioned need. The flexible tube squeezing device of the present invention employs a pair of rigid cylindrical rollers being coupled together by an inelastic coupling strap. The coupling strap is provided in a looped configuration extending through longitudinal passages or bores in the rollers. The looped coupling strap maintains the rollers in alignment with one another. The coupling strap is sufficiently resilient to be capable of applying squeezing pressure via the rollers against the flexible tube when inserted between the rollers.

Accordingly, the present invention is directed to a flexible tube squeezing device which comprises: (a) a pair of elongated hollow rollers, each roller being made of substantially rigid material and defining an elongated interior bore extending between and open at a pair of opposite ends of the roller; and (b) an elongated coupling strap made of a substantially resilient flexible inelastic material and being formed into a looped configuration and inserted through the bores of the rollers. The coupling strap has a pair of opposite ends and is a length sufficient to permit the opposite ends of the strap to extend beyond an adjacent one pair of the pairs of opposite ends of the rollers so that the opposite ends of the strap can be secured together.

The tube squeezing device also comprises means for connecting the opposite ends of the coupling strap together to close the strap in the looped configuration about the adjacent longitudinal portions of the rollers. There is sufficient clearance provided in the interior bores to one side of the strap to permit the strap to be slidably moved relative to the rollers along an endless path defined by the strap in the looped configuration so as to relocate the connecting means into the interior bore of one of the rollers and adjacent to and offset from one side of the endless path.

The length of the coupling strap also is sufficient to retain the rollers in a spaced apart relationship to one another in which a slot is formed therebetween adapted to receive therethrough the closed end of a flexible fluid-dispensing tube. The material of the coupling strap is sufficiently resilient to urge the rollers toward one another to apply squeezing forces to opposite sides of the tube.

More particularly, in a first embodiment the connecting means of the device includes first and second interengaging elements thereon. The first interengaging element is in the form of a plurality of teeth defined on an inner surface of the looped strap at one of the opposite ends of the strap. The second interengaging element is a head formed on the other of the opposite ends of the strap and having a slot defined therethrough of a size which permits the end of the strap containing the plurality of teeth to be inserted through the slot. The head also has an internal finger which extends in an inclined fashion toward one end of the slot and away from the other end thereof so as to engage successive ones of the teeth as the end of the strap is inserted in a first direction through the slot and prevent withdrawing of the strap end in a second opposite direction from the slot. In a second embodiment, the connecting means of the device is a C-shaped gripping element in the form of a metal braid which can be inserted over the ends of the strap and crimped thereabout so as to fasten the gripping element on the strap ends.

The tube squeezing device also comprises an advertising label in a rolled form inserted in at least one of the rollers of the tube squeezing device. At least the one of the rollers in which the rolled label is inserted is made of transparent material. The rolled label hugs a cylindrical interior surface of the one roller. The coupling strap extending through the rollers also extends through the rolled label. The label has indicia, such as ad copy, imprinted on an exterior side thereof which can be viewed and read through the transparent material of the roller.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
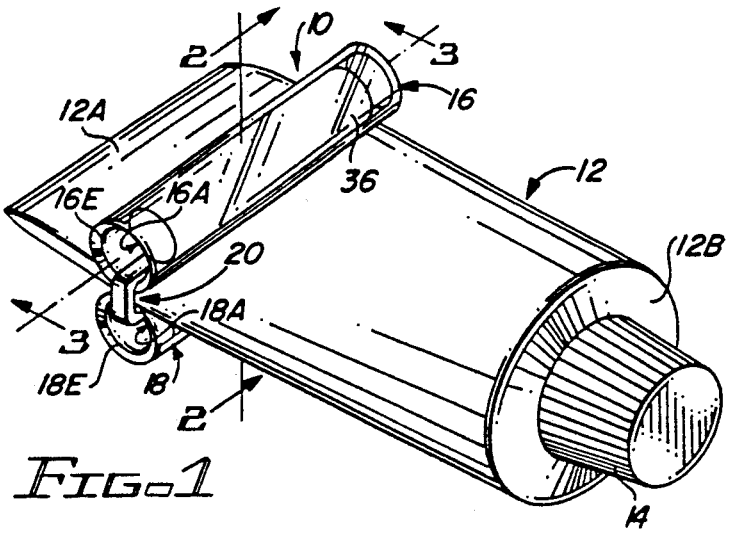
FIG. 1 is a tube squeezing device of the present invention shown applied over a flexible tube near its closed end.
Figure 2:
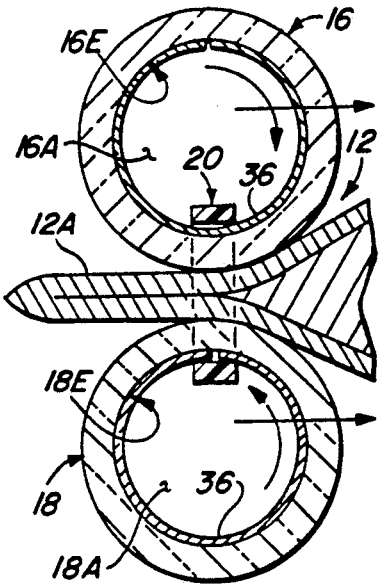
FIG. 2 is an enlarged cross-sectional view of the tube squeezing device taken along line 2—2 of FIG. 1.
Figure 3:
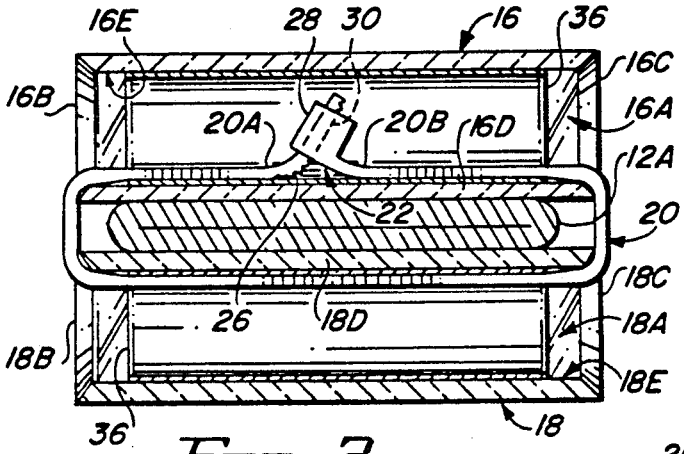
FIG. 3 is an enlarged longitudinal sectional view of the tube squeezing device taken along line 3—3 of FIG. 1.

Referring to the drawings and particularly to FIGS. 1 to 3, there is illustrated a dual roller flexible tube squeezing device of the present invention, being generally designated 10. A flexible tube 12 is shown with the tube squeezing device 10 inserted over opposite sides of its closed end 12A. As the tube squeezing device 10 is moved over the tube 12, it functions to force the contents of the flexible tube 12 to flow toward the open end 12B of the tube 12 closed by a cap 14 and, concurrently, to prevent the fluid contents from spreading back toward the closed end 12A of the tube 12. Thus, the tube squeezing device 10 functions to effectively close off the emptied portion 12C of the flexible tube 12.

Figure 8:
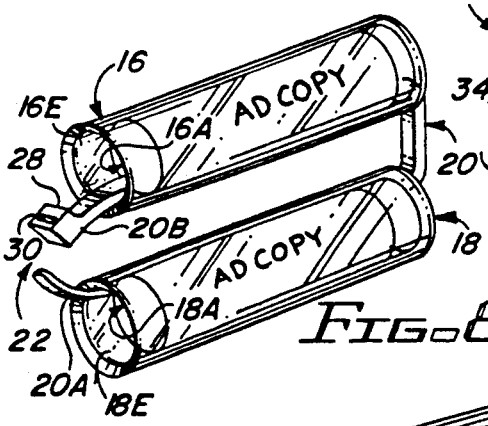
FIG. 8 is an exploded perspective view of tube squeezing device.
Figure 6:
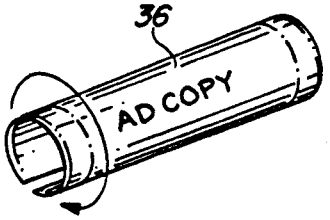
FIG. 6 is a perspective view of an advertising label rolled into the form of a cylinder which can be inserted in one or both of a pair of rollers of the tube squeezing device.

Basically, the tube squeezing device 10 includes a pair of elongated hollow rollers 16, 18 and an elongated coupling strap 20 for rollably coupling the rollers 16, 18 together. Each of the rollers 16, 18 is made of substantially rigid material, such as a suitable plastic, is of cylindrical configuration, and has an elongated cylindrical interior bore 16A, 18A extending between and open at a pair of opposite ends 16B, 16C and 18B, 18C of the respective roller 16, 18. The elongated coupling strap 20 is made of a substantially resilient flexible inelastic material, such as a suitable plastic, and has a substantially rectangular cross-sectional configuration. As seen in FIG. 8, to couple the rollers 16, 18 together, the coupling strap 20 is formed into a looped configuration and inserted through the interior bores 16A, 18A of the rollers 16, 18. The coupling strap 20 has a pair of opposite ends 20A, 20B and is of a length being sufficiently greater than twice the lengths of the rollers 16, 18 to permit the opposite ends 20A, 20B of the strap 20 to respectively extend beyond one adjacent pair 16B, 18B of the opposite ends 16B, 16C and 18B, 18C of the rollers 16, 18 so that they can be secured together.

The tube squeezing device 10 also includes means, generally designated 22, for connecting the opposite ends 20A, 20B of the coupling strap 20 together so as to close and retain the coupling strap 20 in the looped configuration about the adjacent longitudinal portions 16D, 18D of the rollers 16, 18 and thereby couple the rollers 16, 18 together. After securing the ends 20A, 20B of the coupling strap 20 together, the strap 20 is slidably moved along the endless path defined by its looped configuration until the connecting means 22 is moved into the interior bore 16A, 18A of one of the rollers 16, 18 and disposed to one side of the endless path.

As readily apparent in FIGS. 2 and 3, the coupling strap 20 has a cross-sectional size substantially smaller than the cross-sectional side of the interior bore 16A, 18A of each of the rollers 16, 18. This provides sufficient clearance in the interior bores 16A, 18A to the one side of the coupling strap 20 to permit the strap 20 to be readably slidably moved relative to the rollers 16, 18 along the endless path defined about the adjacent longitudinal portions 16D, 18D of the rollers 16, 18 to relocate the connecting means 22 into the interior bore 16A, 18A of a selected one of rollers 16, 18 and adjacent to and offset from the one side of the endless path. Also, the opposite ends 16B, 18B and 16C, 18C of the respective rollers 16, 18 are interiorly beveled, for example at 45°, in order to eliminate any sharp edges which the strap 20 would have to bend around to traverse the endless path and thus provide a source of wear and stress on the strap 20.

The length of the coupling strap 20 is also sufficient to retain the rollers 16, 18 in a spaced apart relationship in which a narrow slot 24 is defined therebetween which is adapted to receive the closed end 12A of the flexible dispensing tube 12 therethrough. The material of the coupling strap 20 is sufficiently resilient to urge the rollers 16, 18 toward one another to apply squeezing forces to the opposite sides of the tube 12, as depicted in FIGS. 1 to 3.

Figure 4:
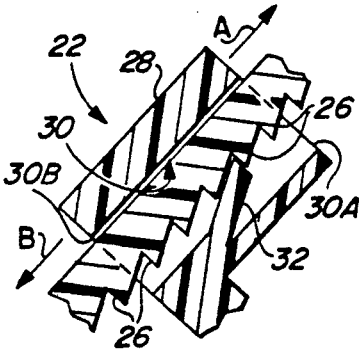
FIG. 4 is an enlarged sectional view of one form of a connection between the opposite ends of a coupling strap of the tube squeezing device of FIG. 3.

Referring to FIGS. 3, 4 and 8, there is illustrated a first embodiment of the connecting means 22 of the tube squeezing device 10. The first embodiment or form of the connecting means 22 includes first and second interengaging elements 26, 28 defined on the strap 20. The first interengaging element 26 is in the form of a plurality of teeth 26 defined on and longitudinally spaced along an inner surface 20C of the looped strap 20 at least at one 20A of the opposite ends 20A, 20B of the strap 20. The second interengaging element 28 is a head 28 formed on the other 20B of the opposite ends 20A, 20B of the strap 20. The head 28 has a slot 30 defined therethrough of a size which permits the one end 20A of the strap 20 containing the plurality of teeth 26 to be inserted through the slot 30. The head 28 also has a flexible internal finger 32 extending in an inclined fashion toward one 30A of a pair of opposite open ends 30A, 30B of the slot 30 and away from the other 30B of the open ends 30A, 30B, thereby adapting the internal finger 32 to be engageable with successive ones of the teeth 26 on the one end 20A of the coupling strap 20 in a manner which permits insertion thereof in a first direction, being depicted by arrow A in FIG. 4, through the slot 30 but blocks withdrawal of the one end 20A of the strap 20 in a second opposite direction, being depicted by arrow B in FIG. 4, from the slot 30.

Figure 5:
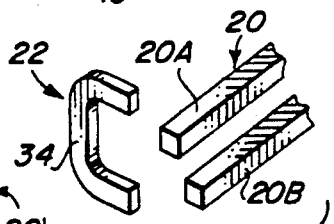
FIG. 5 is a perspective view of another form of the connection between the opposite ends of the coupling strap.

Referring to FIG. 5, in a second embodiment, the connecting means 22 is a gripping element 34 installable over the opposite ends 20A, 20B of the coupling strap 20 and securable thereabout so as to fasten the gripping element 34 on the opposite ends 20A, 20B of the coupling strap 20 and thereby secure the opposite ends of the strap to one another. More particularly, the gripping element 34 is preferably in the form of a metal braid 34 having a generally C-shaped configuration which can be inserted over the opposite ends 20A, 20B of the coupling strap 20 and crimped thereabout so as to fasten the braid 34 on the strap ends.

Figure 9:
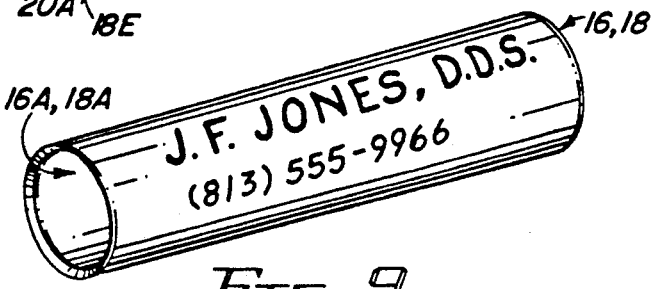
FIG. 9 is a perspective view of one of the rollers of the tube squeezing device with advertising matter imprinted directly on the roller.
Figure 7:
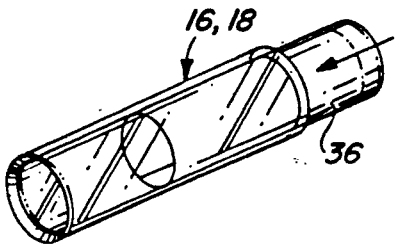
FIG. 7 is a perspective view of the rolled label being inserted into one of the rollers.

Referring to FIGS. 1–3 and 6–8, the tube squeezing device 10 also include a label 36, preferably in a rolled form, being inserted in the interior bore 16A, 16B of at least one and preferably both of the rollers 16, 18. When the rolled labels 36 are to be employed with the rollers 16, 18, the rollers would then be made of transparent material so that the indicia, such as advertising copy, imprinted on outer or exterior sides of the labels 36 can be easily read from the exterior of the rollers 16, 18. The rolled labels 36 hug the cylindrical interior surfaces 16E, 18E of the respective rollers 16, 18. As seen in FIG. 3, the respective portions of the coupling strap 20 extending through the given rollers 16, 18 also extend through the respective rolled labels 16, 18. Preferably, the rolled labels 36 are shorter than the respective rollers 16, 18 so as to terminate inwardly at about 1/4 inch from the opposite ends of the rollers 16, 18 and thereby provide sufficient clearance between the labels 36 and the coupling strap 20 so that the strap 20 can be moved around its endless path to relocate the connecting means 22 without interferring with the position of the labels 36 within the rollers 16, 18. Alternatively, as seen in FIG. 9, advertising matter can be imprinted directly on the exterior of the rollers 16, 18.

In operation, the tube squeezing device 10 is inserted over the closed end 12A of the flexible tube 12. Then, each time the fluid material is dispensed from the tube 12, the tube squeezing device 10 is manually rolled toward the open dispensing end 12B of the tube 12 to gather and maintain the dispensing end of the tube 12 filled with the fluid material. The resiliency of the coupling strap 20 causes a braking action which holds the rollers 16, 18 at whatever position they are stopped along the tube 12.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A flexible tube squeezing device, comprising:

(a) a pair of elongated hollow rollers, each roller being made of substantially rigid material and having an elongated interior bore extending between and open at a pair of opposite ends of said roller;

(b) an elongated coupling strap made of a substantially resilient flexible inelastic material and being formed into a looped configuration and inserted through said bores of said rollers, said coupling strap having a pair of opposite ends and being of a length sufficient to permit said opposite ends of said strap to extend beyond an adjacent one pair of said pairs of opposite ends of said rollers; and (c) means for connecting said opposite ends of said coupling strap together so as to close said strap in said looped configuration about adjacent longitudinal portions of said rollers, said connecting means being offset to one side of an endless path defined about said adjacent longitudinal portions of said rollers by said looped strap, said length of said strap also being sufficient to retain said rollers in a spaced apart relationship in which a narrow gap is defined between said rollers being adapted to receive therethrough a closed end of a flexible fluid-dispensing tube, said material of said strap being sufficiently resilient to urge said rollers toward one another to apply squeezing forces to opposite sides of the tube.

2. The device of claim 1 wherein said connecting means includes first and second interengaging elements defined on said ends of said coupling strap.

3. The device of claim 1 wherein said first interengaging element is a plurality of teeth defined on a surface of said looped coupling strap at least at one of said opposite ends thereof.

4. The device of claim 3 wherein said second interengaging element is a head formed on the other of said opposite ends of said coupling strap and including a slot defined therethrough having a pair of opposite open ends and being of a size adapted to permit said one end of said coupling strap having said teeth to be inserted therethrough.

5. The device of claim 4 wherein said head also includes an internal finger extending in an inclined fashion toward one of said open ends of said slot and away from the other of said open ends thereof thereby adapting said internal finger to be engageable with successive ones of said teeth on said one end of said coupling strap to permit insertion thereof in a first direction through said slot but to block withdrawal of said one end of said strap in a second opposite direction from said slot.

6. The device of claim 1 wherein said connecting means is a gripping element insertable over said opposite ends of said coupling strap and securable thereabout so as to fasten said gripping element on said opposite ends of said coupling strap.

7. The device of claim 6 wherein said gripping element is a metal braid.

8. The device of claim 1 wherein said strap has a cross-sectional size substantially smaller than a crosssectional size of said interior bore of at least one of said rollers so as to define sufficient clearance in said interior bore of said one roller to one side of said coupling strap to permit said strap to be slidably moved relative to said roller along said endless path defined by said looped strap to relocate said connecting means into said interior bore of said one roller and adjacent to and offset from said one side of said endless path.

9. The device of claim 1 further comprising:

a label in a rolled form inserted in at least one of said rollers, said one of said rollers in which said rolled label is inserted being made of transparent material.

10. The device of claim 9 wherein said label has indicia imprinted on an exterior side thereof being readable through said transparent material of said roller.

11. The device of claim 9 wherein a portion of said coupling strap extending through said one roller also extends through said rolled label.

12. A flexible tube squeezing device, comprising:

(a) a pair of elongated hollow rollers, each roller being made of substantially rigid material and defining an elongated interior bore extending between and open at a pair of opposite ends of said roller;

(b) an elongated coupling strap made of a substantially resilient flexible inelastic material and being formed into a looped configuration and inserted through said bores of said rollers, said strap having a pair of opposite ends and being of a length sufficient to permit said opposite ends of said strap to extend beyond an adjacent one pair of said pairs of opposite ends of said rollers; and (c) means for connecting said opposite ends of said strap together so as to close said strap in said looped configuration about adjacent longitudinal portions of said rollers, said coupling strap having a cross-sectional size substantially smaller than a crosssectional size of said interior bore of at least one of said rollers so as to define sufficient clearance in said interior bore of said one roller to one side of said coupling strap to permit said strap to be slidably moved relative to said roller along said endless path defined about said adjacent longitudinal portions of said rollers by said looped strap to relocate said connecting means into said interior bore of said one roller and adjacent to and offset from said one side of said endless path;

(d) said length of said strap also being sufficient to retain said rollers in a spaced apart relationship in which a narrow gap is defined between said rollers being adapted to receive therethrough a closed end of a flexible fluid-dispensing tube, said material of said strap being sufficiently resilient to urge said rollers toward one another to apply squeezing forces to opposite sides of the tube.

13. The device of claim 12 wherein said connecting means includes first and second interengaging elements defined on said ends of said coupling strap.

14. The device of claim 13 wherein said first interengaging element is a plurality of teeth defined on a surface of said looped coupling strap at least at one of said opposite ends thereof.

15. The device of claim 14 wherein said second interengaging element is a head formed on the other of said opposite ends of said coupling strap and including a slot defined therethrough having a pair of opposite open ends and being of a size adapted to permit said one end of said coupling strap having said teeth to be inserted therethrough.

16. The device of claim 15 wherein said head also includes an internal finger extending in an inclined fashion toward one of said open ends of said slot and away from the other of said open ends thereof thereby adapting said internal finger to be engageable with successive ones of said teeth on said one end of said coupling strap to permit insertion thereof in a first direction through said slot but to block withdrawal of said one end of said strap in a second opposite direction from said slot.

17. The device of claim 12 wherein said connecting means is a metal gripping element insertable over said opposite ends of said coupling strap and securable thereabout so as to fasten said gripping element on said opposite ends of said coupling strap.

18. The device of claim 12 further comprising:

a label in a rolled form inserted in at least one of said rollers, said one of said rollers in which said rolled label is inserted being made of transparent material.

19. The device of claim 18 wherein said label has indicia imprinted on an exterior side thereof being readable through said transparent material of said roller.

20. The device of claim 18 wherein a portion of said coupling strap extending through said one roller also extends through said rolled label.

* * * * *